US006093040A

United States Patent [19]

Kodama et al.

[11] Patent Number: 6,093,040

[45] Date of Patent: Jul. 25, 2000

[54] TERMINAL HOUSING CONNECTING STRUCTURE

[75] Inventors: Shinji Kodama; Kei Sato, both of Shizuoka-ken, Japan

[73] Assignee: Yazaki Corporation, Tokyo, Japan

[21] Appl. No.: 09/283,147

[22] Filed: Apr. 1, 1999

[30] Foreign Application Priority Data

Apr. 9, 1998 [JP] Japan ..... 10-097935

[51] Int. Cl.[7] ..... H01R 13/62

[52] U.S. Cl. ..... 439/157; 439/310

[58] Field of Search ..... 439/157, 310, 439/843, 851, 845, 850

[56] References Cited

U.S. PATENT DOCUMENTS

| | | | |
|---|---|---|---|
| 2,599,329 | 6/1952 | Huntington | 464/103 |
| 5,162,004 | 11/1992 | Kuzuno et al. | 439/845 |
| 5,263,871 | 11/1993 | Sano | 439/372 |
| 5,919,055 | 7/1999 | Hattori | 439/310 |
| 5,921,791 | 7/1999 | Ono et al. | 439/157 |

FOREIGN PATENT DOCUMENTS 6-325822 11/1994 Japan .

*Primary Examiner*—Gary F. Paumen
*Assistant Examiner*—Tho D. Ta
*Attorney, Agent, or Firm*—Finnegan, Henderson, Farabow, Garrett & Dunner, L.L.P.

[57] ABSTRACT

A connector 10 includes a female connector housing 11 accommodating male terminals 12, a male connector housing 13 accommodating female terminals 14, and a holder 17 carrying the male connector housing 13 in a sliding manner. The holder 17 is provided with an oblique slot 18, while the male connector housing 13 is provided with a projection 16 for slide engagement with the oblique slot 18. In engaging the male terminals 12 with the female terminals 14, on completion of the engagement between the connector housings 11, 13, the holder 17 is further pressed against the female connector housing 11 in an engagement direction A. Consequently, the pressing operation of the holder 17 is converted into the slide movement of the male connector housing 13 due to the engagement between the projection 16 and the oblique slot 18, so that the electrical connection between the terminals 12, 14 can be completed with low manipulating force.

6 Claims, 5 Drawing Sheets

TERMINAL HOUSING CONNECTING STRUCTURE

BACKGROUND OF THE INVENTION

1. Field of the Invention

The present invention relates to a connector which is capable of carrying out the engagement and disengagement between a male connector housing and a female connector housing with small manipulating force.

2. Description of the Related Art

This kind of connector is disclosed in Japanese Unexamined Patent Publication (kokai) No. 6-325822, as shown in FIGS. 1A to 3. As shown in FIGS. 2 and 3, a connector 1 comprises a male connector housing 2 and a female connector housing 6. The male connector housing 2 is provided, on both side faces thereof, with a pair of pivot shafts 2*a* on which a lever 3 is rotatably mounted. As shown in FIG. 1B, through the intermediary of a bracket 4, the male connector housing 2 is also mounted on a panel body 5 so as to move relatively to the bracket 4 in front and behind.

As shown in FIG. 1A, the female connector housing 6 is provided, on both side faces thereof, with projections 6*a* for engagement and projections 6*b* for disengagement. The lever 3 includes a pair of arm portions 3*a*, 3*a* each of which is assembled so as to slidably extend between the projection 6*a* and the projection 6*b* on each side face of the female connector housing 6. The female connector housing 6 has a hood portion 6*c* formed for engagement with the male connector housing 2.

Provided on the underside of the female connector housing 6 is a rail portion 9 which carries a slider 8 movably in the front and behind. The slider 8 is fixed to a tip of a screw member 7. The slider 8 is also provided with a recess portion 8*a* into which a rod-shaped butting portion 3*b* is being accommodated.

In operation, as shown in FIGS. 2 and 3, the rotation of the screw member 7 allows the lever 3 to pivot in front and in the rear of both connector housings 2, 6, so that the engagement and disengagement therebetween can be accomplished with small manipulation force, by the leverage (magnifying arrangement) of the lever 3 through the projections 6*a*, 6*b*. Note, the similar art in relation with the above-mentioned connector 1 is also disclosed in U.S. Pat. No. 2,599,329 etc.

In the above-mentioned conventional connector 1, however, it has a problem of being large-sized due to the action of the lever 3. Additionally, the connector 1 requires the screw member 7 to be rotated by means of a driver tool, or the like and therefore, the engagement/disengagement operation between the male and female connector housings 2, 6 is complicated and troublesome.

SUMMARY OF THE INVENTION

Under such a circumstance, it is therefore an object of the present invention to provide a multi-polar and compact connector which is capable of engaging and disengaging between the male and female connector housings with simple operation and small manipulating force.

The object of the present invention described above can be accomplished by a connector comprising:

a first connector housing accommodating at least one first terminal therein;

a second connector housing for engagement with the first connector housing, the second connector housing accommodating at least one second terminal being mated with the first terminal, therein;

a holder carrying the second connector housing so as to slide in the holder;

an oblique cam provided on either one of the holder and the second connector housing, the oblique cam being inclined to an engagement direction of the first and second connector housings; and a cam follower provided on the other one of the holder and the second connector housing, for following the oblique cam;

wherein the first and second connector housings are adapted so that, on condition of engaging the first and second connector housings with each other and sequentially further pressing the holder against the first connector housing in the engagement direction of the first and second connector housings, the second connector housing slides in a direction of mating the first and second terminals with each other by the movement of the cam follower following the oblique cam.

According to the invention, with the above-mentioned arrangement, it is possible to carry out the engagement and disengagement between the first and second connector housings with an operator's small manipulating force and simple manipulation. Furthermore, owing to the provision of the oblique cam on either one of the holder and the second connector housing while providing the cam follower on the other one of the holder and the second connector housing, it is possible to simplify and miniaturize the whole connector in comparison with the conventional connector employing a lever for engaging the female and male connector housings with each other.

In the present invention, preferably, the oblique cam is constituted by an oblique slot, while the cam follower is constituted by a column-shaped projection and preferably, the oblique slot is provided, therein, with an engagement part which restricts the projection in both a first position before the second connector housing's sliding and a second position after the second connector housing's sliding.

In this case, owing to the engagement of the projection with the engagement part, it is possible to maintain the connection and disconnection between the first and second terminals easily and certainly.

In the present invention, preferably, the first terminal is constituted by a male terminal in the form of a plate, which is provided, on one side thereof, with a tapered surface, while the second terminal is constituted by a female terminal which has a leading end of substantial U-shaped cross section and an U-shaped bend piece disposed in the leading end, and preferably, the mating between the male terminal and the female terminal is accomplished by inserting the male terminal between the bend piece and an upper piece of the leading end through the tapered surface of the male terminal .

In this case, owing to the provision of the tapered surface, the smooth insertion of the male terminal into the female terminal can be realized. Furthermore, after completing the electrical connection between the male and female terminals, the connection can be maintained by the elasticity of the bend piece.

In the present invention, preferably, the first connector housing is a female connector housing, while the second connector housing is a male connector housing to be inserted into the female connector housing.

With the above establishment, it is possible to carry out the engagement and disengagement between the male and female connector housings with the operator's small manipulating force and simple manipulation.

In the present invention, more preferably, the female connector housing is provided with L-shaped clearance grooves for passing through the projection.

In this case, the operator's inserting the male connector housing into the female connector housing is guided by the L-shaped clearance groove.

In the present invention, preferably, the holder is provided, on an exterior thereof, with a pair of elastic nipping pieces for fixing the holder to an object.

In this case, owing to the provision of the nipping pieces, it is possible to fix the holder on the object, smoothly.

These and other objects and features of the present invention will become more fully apparent from the following description and appended claims taken in conjunction with the accompany drawings.

BRIEF DESCRIPTION OF THE DRAWINGS

FIG. 1A is a perspective view of a female connector housing constituting the conventional connector and FIG. 1B is a perspective view of a male connector housing constituting the conventional connector;

FIG. 4A is a plan view of the connector with a partial section, showing a pre-engagement condition of a female connector housing and a male connector housing and FIG. 4B is a partial perspective view of a male terminal and a female terminal both accommodated in the connector, showing a pre-contact condition of the male and female terminals;

DESCRIPTION OF THE PREFERRED EMBODIMENT

An embodiments of the present invention will be described with reference to the accompanying drawings.

Figure 1A:
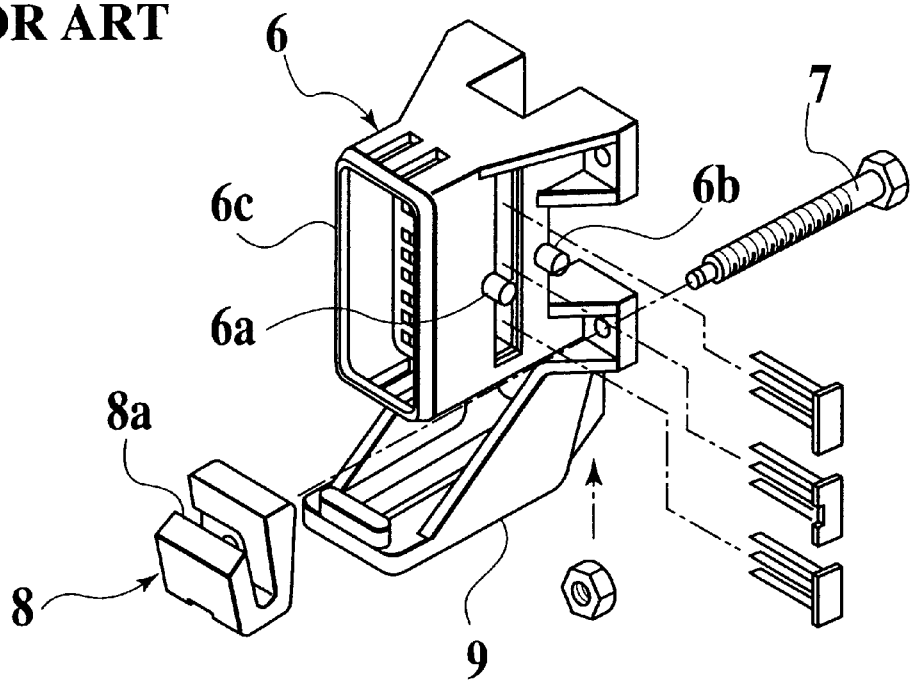
FIG.1A PRIOR ART
FIGS. 1A and 1B show a conventional connector.
Figure 1B:
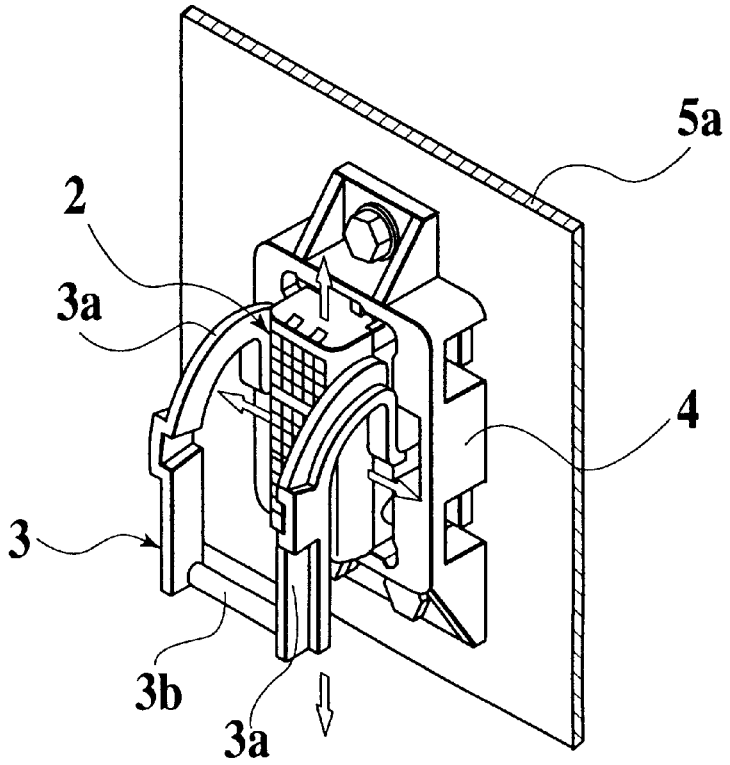
FIG.1B PRIOR ART
Figure 2:
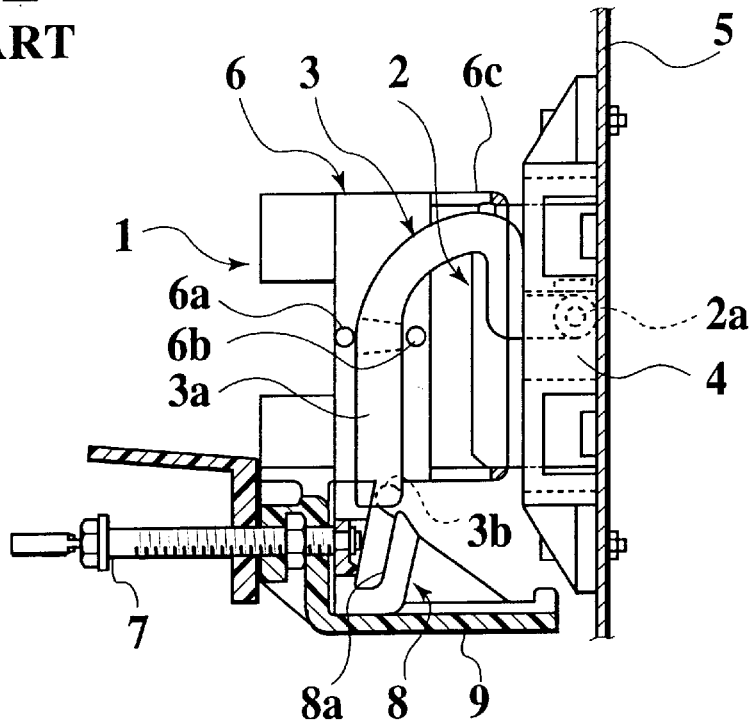
FIG.2 PRIOR ART
FIG. 2 is a side view of the connector consisting of the female and male connector housings of FIGS. 1A and 1B, having a partial cross section and showing a temporary engagement condition of the female and male connector housings.
Figure 3:
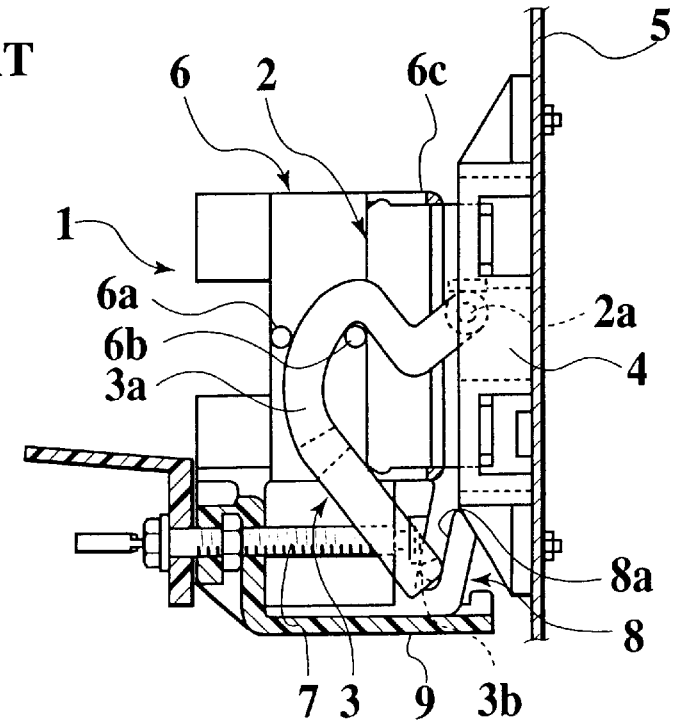
FIG.3 PRIOR ART
FIG. 3 is a side view of the connector consisting of the female and male connector housings of FIGS. 1A and 1B, having a partial cross section and showing a completed engagement condition of the female and male connector housings.
Figure 4A:
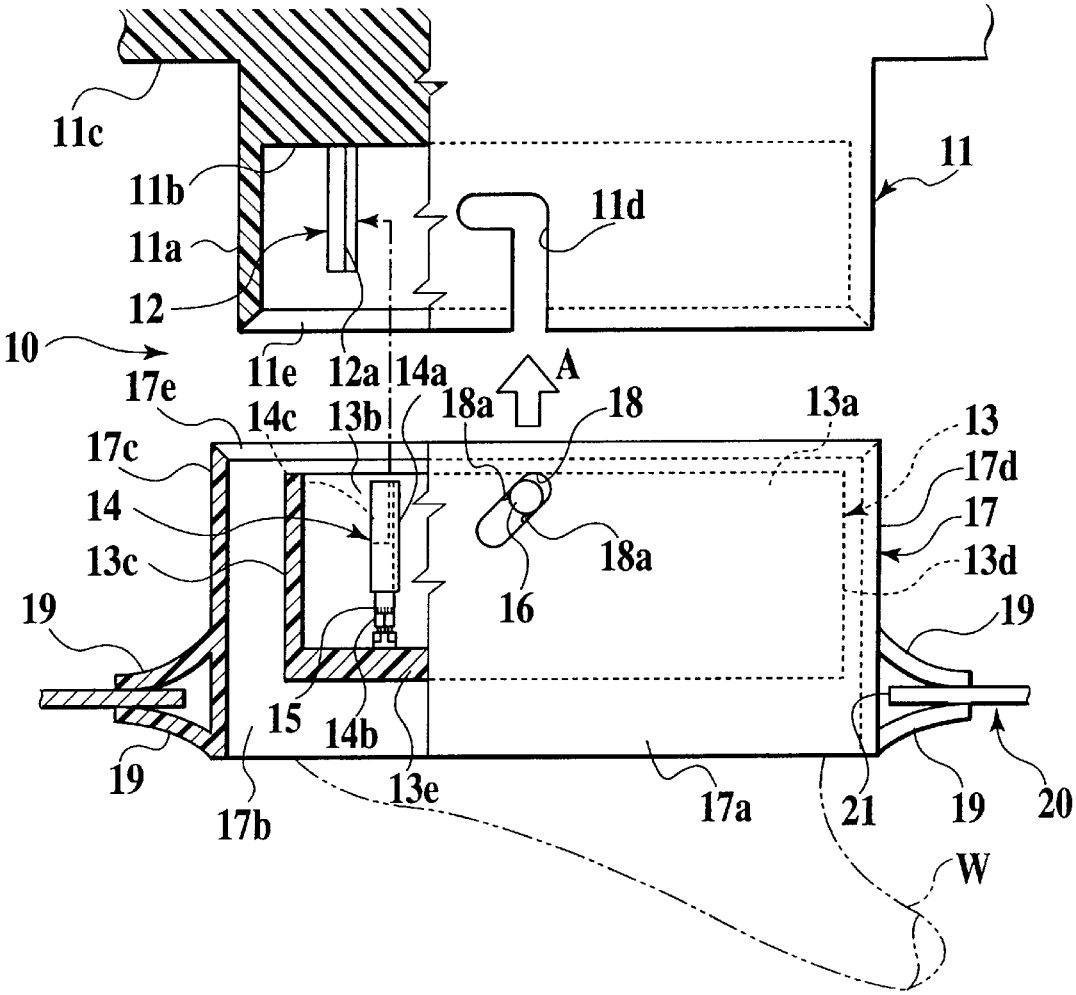
FIGS. 4A and 4B show a connector in accordance with an embodiment of the present invention.
Figure 4B:
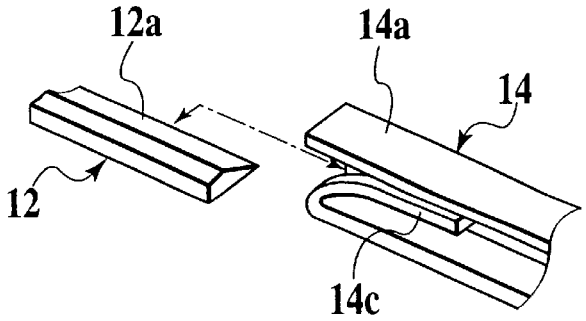
Figure 5:
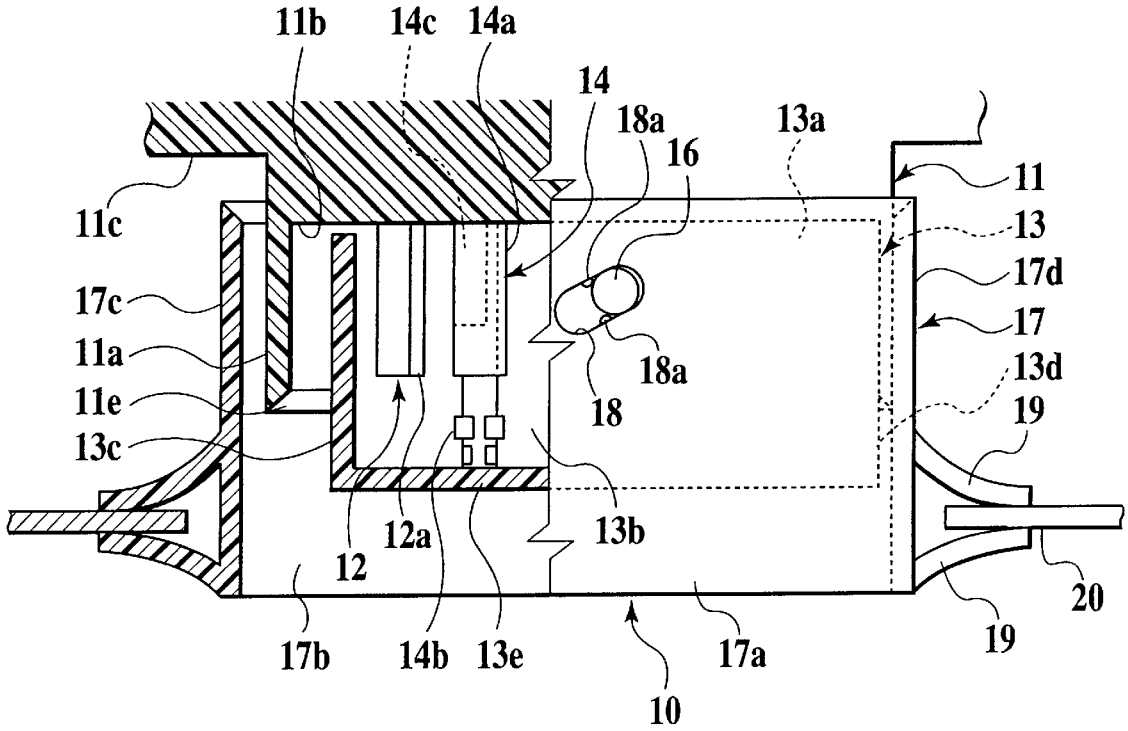
FIG. 5 is a plan view of the connector of FIGS. 4A and 4B with a partial cross section, showing an engagement condition of the male and female connector housings constituting the connector.
Figure 6:
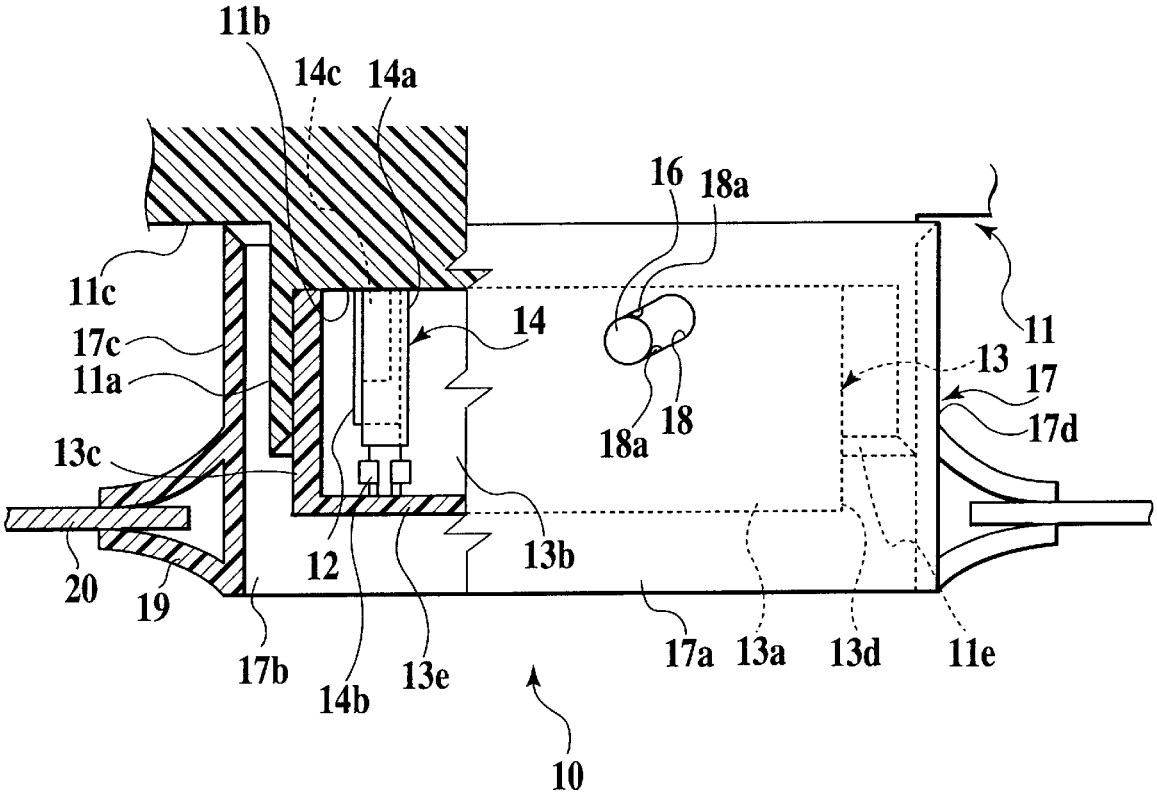
FIG. 6 is a plan view of the connector of FIGS. 4A and 4B with a partial cross section, showing a contact condition of the male and female terminals after engaging the male and female connector housings with each other.

FIG. 4A is a plan view of a connector for vehicle, in accordance with the embodiment of the invention, having a partial section and showing a pre-engagement condition of a female connector housing and a male connector housing. FIG. 4B is a partial perspective view of a male terminal and a female terminal both accommodated in the connector, showing a pre-contact condition of the male and female terminals. FIG. 5 is a plan view of the connector of invention with a partial cross section, showing an engagement condition of the male and female connector housings constituting the connector. FIG. 6 is a plan view of the connector of the invention with a partial cross section, showing a contact condition of the male and female terminals after engaging the male and female connector housings with each other.

As shown in the figures, the connector 10 of the invention is constituted by the female connector housing 11, the male connector housing 13 and a holder 17 in the form of a rectangular cylinder, all of which are made of synthetic resin. The female connector housing 11 has a box-shaped hood portion 11*a* for accommodating a plurality of male terminals 12 therein. The box-shaped male connector housing 13 is adapted so as to detachably engage in the hood portion 11*a* of the female connector housing 11. Accommodated in the male connector housing 13 are a plurality of female terminals 14 for respective contact with the male terminals 12. The male connector housing 13 is overlapped with the holder 17 and carried therein so as to be slidable to both left and right directions perpendicular to a direction A to engage the male connector housing 13 in the female connector housing 11. The male connector housing 13 and the holder 17 are attached to a not-shown instrumental panel of a vehicle.

The female connector housing 11 has a base portion 11*c* fixed to a not-shown meter board. The hood portion 11*a* of the female connector housing 11 has its front side opened. In the hood portion 11*a,* the male terminals 12 are arranged so as to protrude from a bottom face 11*b* of the hood portion 11*a* at regular intervals in upward, downward, left and right directions of the female connector housing 11. As shown in FIG. 4B, each male terminal 12 is in the form of a rectangular plate, provided with a tapered surface 12*a* on one side (i.e. the right side in the figure) of the plate.

The male connector housing 13 is in the form of a front-opening box consisting of an upper wall 13*a,* a lower wall 13*b,* a left sidewall 13*c,* a right sidewall 13*d* and a bottom wall 13*e*. Further, the male connector housing 13 has column-shaped projections (cam follower) 16 integrally formed on respective external faces of the upper and lower walls 13*a,* 13*b,* at respective front and central positions thereof. Similarly to the female connector housing 11, the female terminals 14 are arranged so as to protrude from a bottom wall 13*e* of the connector housing 13 at regular intervals in upward, downward, left and right directions thereof. As shown in FIGS. 4A and 4B, each female terminal 14 has a substantially U-shaped leading part 14*a* and a crimp part 14*b* for press-fitting an electric wire 15 therein. In the leading part 14*a,* an U-shaped bend piece 14*c* is provided by turning over a part of the female terminal 14. In handling the connector 1, the engagement between the male terminal 12 and the female terminal 14 is accomplished by inserting the male terminal 12 between the bend piece 14*c* and an upper piece of the leading part 14*a* through the tapered surface 12*a* of the male terminal 12. The electrical wires 15 connected to the respective female terminals 14 are collected and bundled to constitute a wire harness W.

The holder 17 is in the form of a both (front and rear) opening rectangular cylinder consisting of an upper wall 17*a,* a lower wall 17*b,* a left sidewall 17*c* and a right sidewall 17*d*. The holder 17 carries the male connector housing 13 between the upper wall 17*a* and the lower wall 17*b* so that the housing 13 can slide in both left and right directions perpendicular to the engagement direction A of the connector 10. Further, the holder 17 is provided, on the upper and lower walls 17*a,* 17*b,* with a pair of oblique slots (oblique cams) 18. Each oblique slot 18 is inclined to the engagement direction A and positioned at a front and central position of the wall 17*a* (17*b*). The column-shaped projections 16 are adapted so as to slide in and along the oblique slots 18. Furthermore, at substantial centers of opposing faces of each oblique slot 18, a pair of U-shaped swellings 18*a*, 18*a* (engagement portions) are formed integrally with the holder 17, for restricting the projection 16 in a position before sliding the male connector housing 13 (i.e., the position of FIG. 5 showing the pre-engagement state between the terminals 12, 14) and another position after sliding the same (i.e., the position of FIG. 6 showing the engagement state between the terminals 12, 14).

As shown in FIG. 5, under condition that the projections 16 of the male connector housing 13 occupy on the front side of the swellings 18*a* of the oblique slots 18 of the holder 17, narrow spaces are defined between the upper wall 13*a* of the male connector housing 13 and the upper wall 17*a* of the holder 17, between the lower wall 13*b* and the lower wall 17*b* and between the right sidewall 13*d* and the right sidewall 17*d*, respectively. In arrangement, the upper and lower walls and the right sidewall of the hood portion 11*a* are inserted into these narrow spaces, respectively. While, defined between the left sidewall 13*c* of the male connector housing 13 and the left sidewall 17*c* of the holder 17 is a wide clearance (sliding space) into which the left sidewall of the hood portion 11*a* of the female connector housing 11 is being inserted with a great room. After engaging the female connector housing 11 with the male connector housing 13 and when further pushing the holder 17 against the female connector housing 11 in the engagement direction A, then the male connector housing 13 is slid to the left hand of the figure, in other words, a direction to connect the terminals 12, 14 with each other, through the projections 16 and the oblique slots 18.

Hereupon, it is noted that the upper and lower walls of the hood portion 11*a* of the female connector housing 11 are provided, at respective positions thereof opposing the projections 16, with L-shaped clearance grooves 11*d* for passing through the projections 16 respectively. Additionally, the female connector housing 11 has a tapered face 11*e* formed on a front end of the hood portion 11*a*. Similarly, the holder 17 is provided, on a front end thereof, with a tapered face 17*e*. On each of the sidewalls 17*c*, 17*d* of the holder 17, a pair of elastic nipping pieces 19, 19 are integrally formed to project from an external rear part of the sidewall, for nipping the periphery of a mount hole 21 of a panel body 20 (as an object being mounted).

According to the connector 10 of the embodiment, as shown in FIG. 4A, the male connector housing 13, which is temporarily engaged in the holder 17 by the swellings 18*a*, 18*a* of the oblique slots 18 through the projections 16, is inserted into the hood portion 11*a* of the female connector housing 11. During this insertion, since the male terminals 12 in the female connector housing 11 do not come in contact with the female terminals 14 in the male connector housing 13 yet, the male connector housing 13 can be inserted into the female connector housing 11 with a remarkably small insertion force until the male housing 13 abuts on the bottom face 11*b* of the hood portion 11*a* of the female housing 11.

As shown in FIG. 5, at a point of time of the male connector housing's reaching the formal position where the leading end of the male connector housing 13 comes into contact with the bottom face 11*b* in the hood portion 11*a* of the female connector housing 11, the insertion of the male connector housing 13 into the female connector housing 11 is completed. Upon completion of the male connector housing's insertion, when further forcing the holder 17 to the base portion 11*c* of the female connector housing 11 in the engagement direction A, the projections 16 on the male connector housing 13 are guided by the oblique slots 18 respectively, so that the male connector housing 13 does slide to the left hand, as shown in FIG. 6. With this slide movement of the male connector housing 13, the leading parts 14*a* of the female terminals 14 in the male connector housing 13 are brought into contact with the male terminals 12 in the female connector housing 11 respectively, whereby the engagement between the connector housings 11, 13 can be completed.

In this way, on condition of engaging the female and male connector housings 11, 13 with each other and sequentially pressing the holder 17 against the female connector housing 11 in the engagement direction A, the male connector housing 13 can be slid in a direction to connect the female terminals 14 with the male terminals 12. Thus, with an operator's small manipulating force and simple manipulation, it is possible to engage the connector housings 11, 13 with each other. Similarly, the withdrawal of the holder 17 from the female connector housing 11 allows both connector housings 11, 13 to separate from each other with the operator's small manipulating force and simple manipulation.

Further, since the projections 16 of the male connector housing 13 and the oblique slots 18 of the holder 17 do not project to the outside so much, it is possible to simplify and miniaturize the structure of the whole connector in comparison with that of the conventional connector. Additionally, owing to the engagement of the pair of swellings 18*a*, 18*a* of each projection 16, it is possible to maintain the engagement and disengagement between the male and female terminals 12, 14 of the female and male connector housings 11, 13 easily and certainly. Further, owing to the above-mentioned configuration of the male and female terminals 12, 14, it is possible to connect the male and female terminals 12, 14 with each other smoothly and also maintain the connection certainly.

In the above-mentioned embodiment, it is noted that the male connector housing is provided with the projections as the cam follower, while the holder is provided with the oblique slots as the oblique cam. In the modification, on the contrary, the male connector housing may be provided with the oblique slots while the holder is provided with the projections. Additionally, the oblique cam is not limited to the oblique slot of the embodiment. For example, it may be replaced with an oblique recess.

Finally, it will be understood by those skilled in the art that the foregoing description is related to one preferred embodiment of the disclosed connector and that various changes and modifications may be made to the present invention without departing from the spirit and scope thereof.

What is claimed is:

1. A connecting structure comprising:

a first connector housing accommodating at least one first terminal therein;

a second connector housing engageable with the first connector housing from a first direction, the second connector housing accommodating at least one second terminal configured to mate with the at least one first terminal from a second direction, wherein the first direction and the second direction are not parallel;

a holder carrying the second connector housing to be slidable in the holder;

a cam mechanism provided on the holder, the first connector housing and the second connector housing, for converting movement of the holder along the first direction into sliding movement of the second connector housing relative to the holder in the second direction.

2. A connecting structure as claimed in claim 1, wherein the first connector housing is a female connector housing, while the second connector housing is a male connector housing to be inserted into the female connector housing.

3. A connecting structure as claimed in claim 1, wherein the holder is provided, on an exterior thereof, with a pair of elastic nipping pieces for fixing the holder to an object.

4. A connecting structure as claimed in claim 1, wherein the cam mechanism comprises:

a clearance groove formed in the first connector housing so as to extend in the first and second directions;

a slant cam formed on one of the holder and the second connector housing so as to incline to the first direction in engaging the first connector housing with the second connector housing; and a cam follower provided on the other one of the holder and the second connector housing for following the slant cam.

5. A connecting structure as claimed in claim 4, wherein the slant cam is constituted by a slant slot in the form of an elongated hole, the cam follower is constituted by a column-shaped projection, and wherein the slant slot is provided, therein, with an engagement part which restricts the projection in both a first position before sliding of the second connector housing and a second position after sliding of the second connector housing.

6. A connecting structure as claimed in claim 5, wherein the at least one first terminal comprises a male terminal in the form of a plate, having, on one side thereof, a tapered surface, while the at least one second terminal comprises a female terminal having a leading end of substantial U-shaped cross section and an U-shaped bend piece disposed in the leading end, and wherein the mating between the male terminal and the female terminal is accomplished by inserting the tapered surface of the male terminal between the bend piece and an upper piece of the leading end.

* * * * *